US008952775B2

(12) United States Patent
Mitsubori

(10) Patent No.: US 8,952,775 B2
(45) Date of Patent: Feb. 10, 2015

(54) SUPERCONDUCTIVE MAGNET

(71) Applicant: Sumitomo Heavy Industries, Ltd., Tokyo (JP)

(72) Inventor: Hitoshi Mitsubori, Kanagawa (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 32 days.

(21) Appl. No.: 14/256,617

(22) Filed: Apr. 18, 2014

(65) Prior Publication Data

US 2014/0361859 A1 Dec. 11, 2014

(30) Foreign Application Priority Data

Apr. 19, 2013 (JP) ..... 2013-088512

(51) Int. Cl.
*H01F 6/00* (2006.01)
*H01F 6/06* (2006.01)

(52) U.S. Cl.
CPC ..... *H01F 6/06* (2013.01); *Y10S 505/879* (2013.01)
USPC ..... 335/299; 335/216; 505/879

(58) Field of Classification Search
USPC ..... 335/216, 299; 324/318–320; 336/DIG. 1; 505/163, 211, 844, 879, 505/880, 893
See application file for complete search history.

(56) References Cited

U.S. PATENT DOCUMENTS

| | | | | |
|---|---|---|---|---|
| 5,032,869 | A * | 7/1991 | Herd et al. | 335/216 |
| 5,111,172 | A * | 5/1992 | Laskaris | 335/216 |
| 7,522,027 | B2 * | 4/2009 | Calvert et al. | 335/299 |
| 7,883,656 | B2 * | 2/2011 | Calvert | 264/272.19 |
| 8,653,920 | B2 * | 2/2014 | Huang et al. | 335/216 |

FOREIGN PATENT DOCUMENTS

| | | |
|---|---|---|
| JP | S63-297292 A | 12/1988 |
| JP | 2004-319777 A | 11/2004 |

* cited by examiner

*Primary Examiner* — Ramon Barrera
(74) *Attorney, Agent, or Firm* — Rader, Fishman & Grauer PLLC

(57) ABSTRACT

A superconductive magnet includes a superconductive coil that is an air-core coil; a pair of bobbin bodies that support the superconductive coil while interposing the superconductive coil therebetween on both sides of a center axial line direction of the superconductive coil; an outer circumference-side binding portion that extends in the center axial line direction on an outer circumferential side of the superconductive coil to bind the pair of bobbin bodies; and a belt-shaped or a wire-shaped inner circumference-side tension imparted portion which extends in the center axial line direction on an inner circumferential side of the superconductive coil to connect the pair of bobbin bodies, and on which tension is imparted in the center axial line direction.

6 Claims, 5 Drawing Sheets

SUPERCONDUCTIVE MAGNET

INCORPORATION BY REFERENCE

Priority is claimed to Japanese Patent Application No. JP2013-088512, filed Apr. 19, 2013, the entire content of which is incorporated herein by reference.

BACKGROUND

1. Technical Field

The present invention relates to a superconductive magnet that has a superconductive coil.

2. Description of the Related Art

For example, a technology in this field is disclosed in the related art. A superconductive magnet of the related art includes a cylindrical vacuum chamber, and a space is formed in a center portion of the vacuum chamber to pass therethrough in a vertical direction. A superconductive coil is disposed in the vacuum chamber to generate a high magnetic field in the space. The superconductive coil is wound around a bobbin, and the bobbin is configured to have a cylindrical inner bobbin and a pair of flanges each of which is formed in each end of the inner bobbin. Cooling means integrated with a Gifford McMahon (GM) refrigerator is provided above the superconductive coil. A cold head of the cooling means is connected to an upper flange via a cooling stage. Since the superconductive coil is cooled by the cooling means, a high magnetic field can be generated.

The superconductive magnet of the related art is applied to an apparatus that pulls up a silicon single crystal, and is used as a source of a high magnetic field in a so-called magnetic Czochralski (MCZ) method. For example, an apparatus of the related art is an apparatus that pulls up a silicon single crystal using the MCZ method. The apparatus includes a crucible that accommodates a single crystal silicon raw material, and a magnet is provided on a side of the crucible as the source of the high magnetic field. The magnet of the related art is configured to have an air-core coil that does not have the inner bobbin.

SUMMARY

A superconductive magnet according to an embodiment of the present invention includes a superconductive coil that is an air-core coil; a pair of bobbin bodies that support the superconductive coil while interposing the superconductive coil therebetween on both sides of a center axial line direction of the superconductive coil; an outer circumference-side binding portion that extends in the center axial line direction on an outer circumferential side of the superconductive coil to bind the pair of bobbin bodies; and a belt-shaped or a wire-shaped inner circumference-side tension imparted portion which extends in the center axial line direction on an inner circumferential side of the superconductive coil to connect the pair of bobbin bodies, and on which tension is imparted in the center axial line direction.

DETAILED DESCRIPTION

Figure 1:
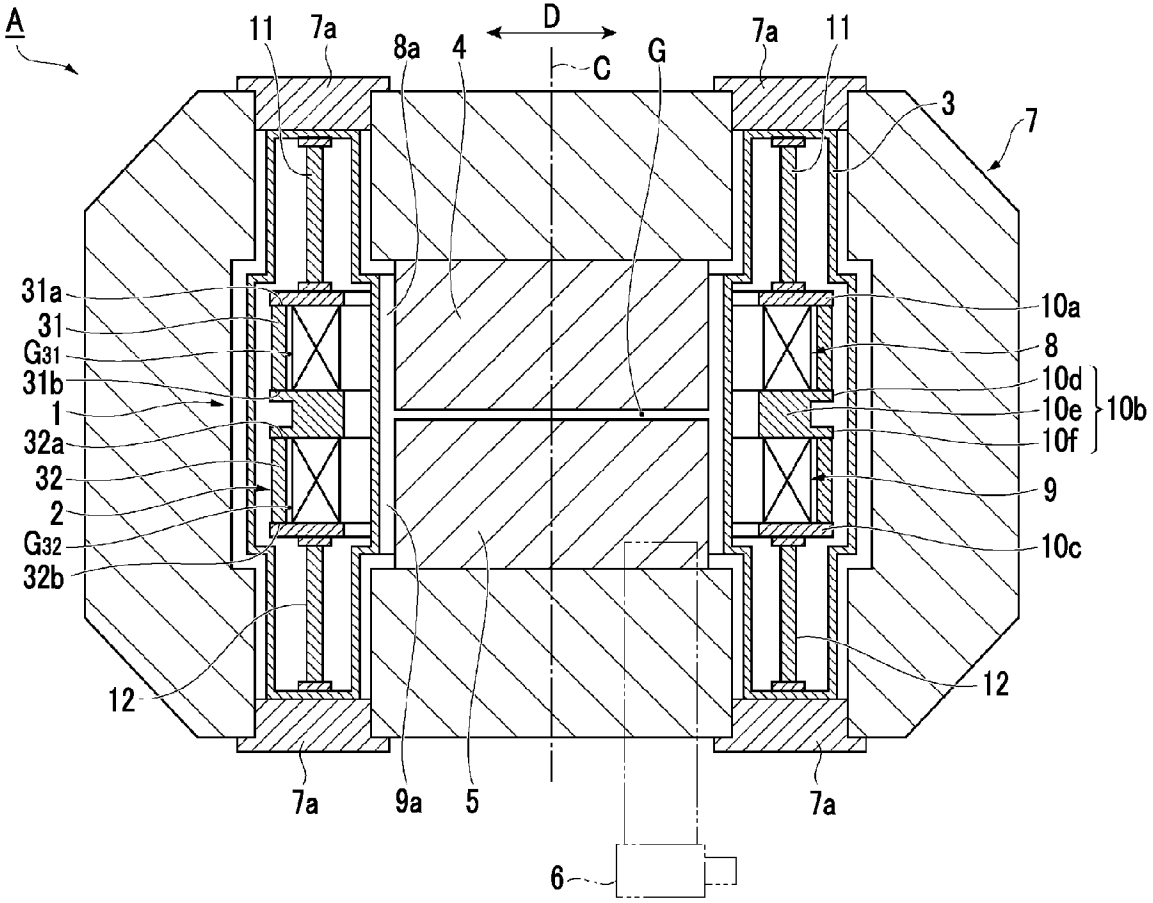
FIG. 1 is a schematic cross-sectional view illustrating a superconductive magnet of one embodiment according to the present invention.

It is necessary to cool the coil down to a very low temperature in order to put the coil in a superconductive state. When wires of the coil shrink and oscillate, that is, a wire movement occurs, a wire is displaced relative to an adjacent wire or the inner bobbin, thereby generating frictional heat. When a temperature of the coil reaches a critical temperature due to the frictional heat, the superconductive state is collapsed. The collapse of the superconductive state is referred to as quench. The air-core coil is required to be adopted to suppress the occurrence of the quench. Since mechanical binding force is not applied to an inner circumferential side of the air-core coil that does not have the inner bobbin, it is necessary to provide a member which generates a binding force on the inner circumferential side of the coil.

In design of the superconductive magnet, design conditions, for example, a magnetic field by the superconductive magnet, a current for generating the magnetic field and the like, are calculated, and design factors, for example, the number of coil windings, an inner diameter of the coil and the like are determined based on the design conditions. Since the design factors are determined, and then disposition of a component for retaining the coil is determined, a space for the disposition of the component becomes limited on the inner circumferential side of the coil. Therefore, a deficiency occurs when the design is changed to make the inner diameter of the coil great and to ensure the space for the disposition of the component, the magnetic field becomes small, and thus it is necessary to increase the number of coil windings or a current of the coil. When the design of the coil is changed in this manner, for example, the superconductive magnet is prevented from being downsized.

It is desirable to provide a superconductive magnet which includes a superconductive coil that is an air-core coil, and in which the superconductive coil can be bound and occurrence of quench can be reduced by disposing a mechanical binding member even though there is a narrow space for the disposition of the component available on an inner circumferential side of the superconductive coil.

According to the superconductive magnet, since the superconductive coil is the air-core coil, there is no inner bobbin on the inner circumferential side of the superconductive coil. Accordingly, the superconductive coil and the inner bobbin do not rub against each other, and frictional heat does not occur. Accordingly, occurrence of quench can be reduced. The superconductive magnet includes the pair of bobbin bodies that support the superconductive coil while interposing the superconductive coil therebetween on both sides of the center axial line direction of the superconductive coil. The pair of bobbin bodies are bound by the outer circumference-side binding portion that extends in the center axial line direction on the outer circumferential side of the superconductive coil. In addition, the pair of bobbin bodies are bound by the belt-shaped or the wire-shaped inner circumference-side tension imparted portion which extends in the center axial line direction on the inner circumferential side of the superconductive coil. Since the inner circumference-side tension imparted portion is formed in a belt shape or a wire shape, it is possible to dispose the tension imparted portion on the inner circumferential side of the superconductive coil even though there is only a small space available on the inner circumferential side of the superconductive coil. Since the inner circumference-side tension imparted portion is connected to the pair of bobbin bodies while the tension in the center axial line direction is imparted on the inner circumference-side tension imparted portion, it is possible to bind the pair of bobbin bodies and retain the superconductive coil on both sides of the center axial line direction.

The superconductive magnet may be configured to further include a tension adjustment portion that can adjust the tension imparted on the inner circumference-side tension imparted portion. According to the superconductive magnet with this configuration, it is possible to suitably bind the superconductive coil by adjusting the tension imparted on the inner circumference-side tension imparted portion. The pair of bobbin bodies are drawn toward each other by increasing the tension and thus, it is possible to increase a tightening force. It is possible to relax the tightening force of the pair of bobbin bodies by decreasing the tension. Accordingly, it is possible to reliably bind the superconductive coil.

The tension adjustment portion may have a bar-shaped tightening member that tightens end portions in a longitudinal direction of the inner circumference-side tension imparted portion to the bobbin bodies, and may adjust the tension imparted on the inner circumference-side tension imparted portion by adjusting the tightening of the tightening member. According to the superconductive magnet with this configuration, it is possible to move the end portion of the inner circumference-side tension imparted portion and to adjust the tension by tightening or untightening the bar-type tightening member.

The tightening member may extend in a diameter direction of the superconductive coil on an outer surface in the center axial line direction of the bobbin body. The end portion in the longitudinal direction of the inner circumference-side tension imparted portion may be disposed on the outer surface in the center axial line direction of the bobbin body. The inner circumference-side tension imparted portion may be in contact with an end portion on the inner circumferential side of the bobbin body, and may be bent toward the inner circumferential side of the superconductive coil from an outer-surface side in the center axial line direction of the bobbin body. The end portion, which is on the inner circumferential side of the bobbin body and is in contact with the inner circumference-side tension imparted portion, may be preferably subjected to a round chamfering process. When the end portion on the inner circumferential side of the bobbin body is subjected to the round chamfering process in this manner, it is possible to bend the inner circumference-side tension imparted portion along a curved surface of the end portion. It is possible to reduce a possibility of frictional heat generating due to rubbing between the inner circumference-side tension imparted portion and the end portion on the inner circumferential side of the bobbin body, and to suppress occurrence of the quench.

The superconductive magnet may preferably have a gap provided between the superconductive coil and the inner circumference-side tension imparted portion in the diameter direction of the superconductive coil. Accordingly, the superconductive coil and the inner circumference-side tension imparted portion can be configured not to come into contact with each other, there is no possibility of frictional heat generating due to the rubbing between the superconductive coil and the inner circumference-side tension imparted portion, and occurrence of the quench can be prevented.

The end portion of the bobbin body on the inner circumferential side of the superconductive coil may project to the inside farther than an inner circumferential surface of the superconductive coil. Accordingly, it is possible to easily provide the gap between the superconductive coil and the inner circumference-side tension imparted portion by bringing the inner circumference-side tension imparted portion into contact with the end portion on the inner circumferential side of the bobbin body and regulating a position of the inner circumference-side tension imparted portion.

Hereinafter, embodiments of the present invention will be described with reference to the accompanying drawings. Hereinafter, a case where a superconductive magnet according to the present invention is applied to a cyclotron will be described.

One Embodiment

As illustrated in FIG. 1, a cyclotron A is a circular accelerator that accelerates an electrically charged particle supplied from a source (not illustrated) of an ion to output an electrically charged particle beam. For example, a proton, a baryon (a heavy ion) or the like is used as the electrically charged particle. The cyclotron A has a superconductive magnet 1.

When a current flows through superconductive coils 8 and 9 that are cooled by a refrigerator 6 and put in a superconductive state, the superconductive magnet 1 generates a powerful magnetic field. The cyclotron A accelerates an electrically charged particle to output an electrically charged particle beam by generating a magnetic field using the superconductive magnet 1.

The superconductive magnet 1 includes a superconductive coil body 2 that has two superconductive coils 8 and 9 coaxially disposed; a annular vacuum chamber 3 that accommodates the superconductive coils 8 and 9; an upper pole 4 and a lower pole 5 that are respectively disposed in air-core portions 8*a* and 9*a* of the superconductive coils 8 and 9; a refrigerator (cooling means) 6 that cools the superconductive coils 8 and 9; and a yoke 7. The yoke 7 is a hollow disc type block, and the vacuum chamber 3, the upper pole 4 and the lower pole 5 are disposed in the yoke 7.

The superconductive coil body 2 includes annular superconductive coils 8 and 9 that are disposed about a center axial line C; an annular plate-shaped upper ring member 10*a* that is disposed in a center axial line C direction on an upper end of the superconductive coil 8; an annular intermediate bobbin body 10*b* that is interposed between the superconductive coils 8 and 9; and an annular plate-shaped lower ring member 10*c* that is disposed in the center axial line C direction on a lower end of the superconductive coil 9. The intermediate bobbin body 10*b* has a flange portion 10*d* that is positioned on an upper end of the intermediate bobbin body 10*b*; a flange portion 10*f* that is positioned on a lower end thereof; and a cylindrical portion 10*e* that connects the flange portion 10*d* and the flange portion 10*f*. The upper ring member 10*a*, the intermediate bobbin body 10*b* and the lower ring member 10*c* can be made of metal, for example, steel, stainless steel or copper. The flange portion 10*d* projects to the outside on the upper end of the cylindrical portion 10*e*, and the flange portion 10*f* projects to the outside on the lower end of the cylindrical portion 10*e*.

Figure 2:
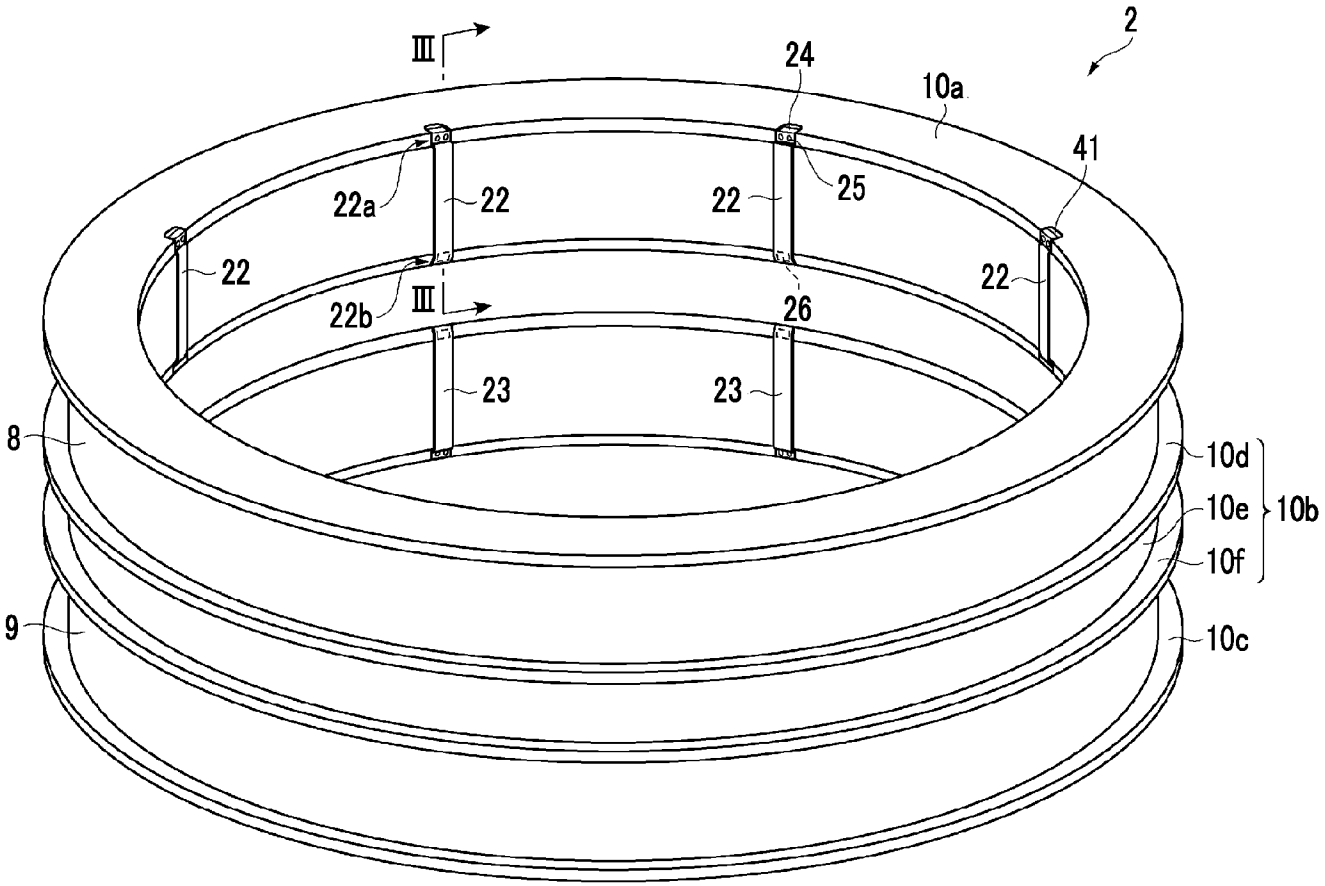
FIG. 2 is a perspective view illustrating the superconductive magnet in FIG. 1.

As illustrated in FIGS. 1 and 2, the superconductive coils 8 and 9 are air-core coils each of which does not have an inner bobbin provided on an inner circumferential side thereof, and an inner circumferential surface of the coil (a wire and an adhesive material that fixes the wire) is not bonded and fixed by another member. The superconductive coils 8 and 9 are disposed side by side in the center axial line C direction.

When the air-core coil is manufactured, the coil is formed by winding the wire around the cylindrical bobbin, the wire is fixed using an adhesive material such as an epoxy resin, and then the bobbin is pulled out of the position. As a result, the air-core coil can be obtained.

The upper ring member 10*a* and the cylindrical portion 10*e* are disposed to face each other in the center axial line C direction and interpose the superconductive coil 8 therebetween. The cylindrical portion 10*e* and the lower ring member 10*c* are disposed to face each other in the center axial line C direction and interpose the superconductive coil 9 therebetween. The upper ring member 10*a*, the intermediate bobbin body 10*b* and the lower ring member 10*c* are supporting members that support the superconductive coils 8 and 9.

The superconductive coil body 2 includes reinforcement rings 31 and 32 that cover respective outer circumferential sides of the superconductive coils 8 and 9. In FIG. 2, the reinforcement rings 31 and 32 are not illustrated. For example, the reinforcement rings 31 and 32 are cylindrical bodies, and are disposed coaxially with the center axial line C of the superconductive coils 8 and 9.

The reinforcement ring 31 connects the upper ring member 10*a* and the flange portion 10*d* which are disposed on both sides of the center axial line C direction. The upper ring member 10*a* is fixed to an upper end surface 31*a* of the reinforcement ring 31, and the flange portion 10*d* is fixed to a lower end surface 31*b* of the reinforcement ring 31. For example, the upper ring member 10*a* and the flange portion 10*d* are coupled to the reinforcement ring 31 using bolts. A gap $G_{31}$ is formed between the reinforcement ring 31 and the superconductive coil 8 in a diameter direction D of the superconductive coil 8.

The reinforcement ring 32 connects the flange portion 10*f* and the lower ring member 10*c* which are disposed on both sides of the center axial line C direction. The flange portion 10*f* is fixed to an upper end surface 32*a* of the reinforcement ring 32, and the lower ring member 10*c* is fixed to a lower end surface 32*b* of the reinforcement ring 32. For example, the flange portion 10*f* and the lower ring member 10*c* are coupled to the reinforcement ring 32 using bolts. A gap $G_{32}$ is formed between the reinforcement ring 32 and the superconductive coil 9 in the diameter direction D of the superconductive coil 9.

The reinforcement rings 31 and 32 function as outer circumference-side binding portions that respectively bind a pair of bobbin bodies apart from each other in the center axial line C direction on the outer circumferential sides of the superconductive coils 8 and 9.

Figure 3:
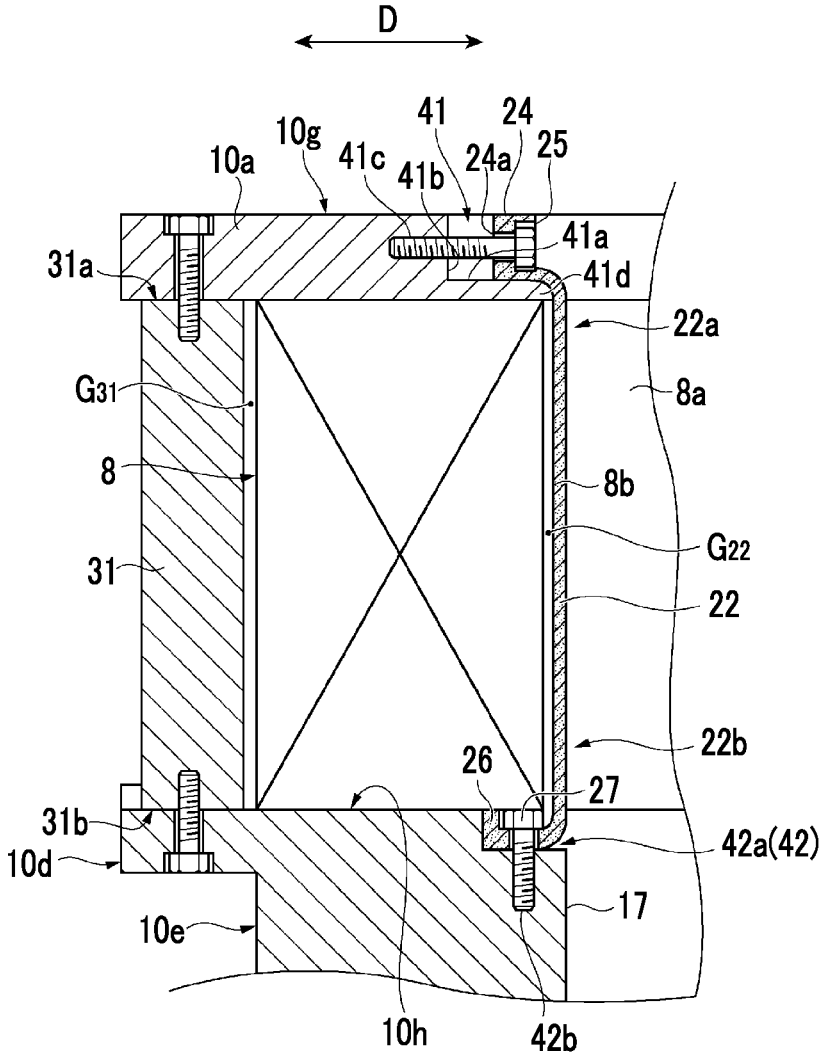
FIG. 3 is a cross-sectional view taken along line in FIG. 2.

As illustrated in FIGS. 2 and 3, the superconductive coil body 2 has a plurality of bands 22 (belt-shaped inner circumference-side tension imparted portions) provided on the inner circumferential side of the superconductive coil 8, and the bands 22 tie the upper ring member 10*a* and the cylindrical portion 10*e* together. The superconductive coil body 2 has a plurality of bands 23 (belt-shaped inner circumference-side tension imparted portions) provided on the inner circumferential side of the superconductive coil 9, and the bands 23 tie the cylindrical portion 10*e* and the lower ring member 10*c* together. Each of the bands 22 and 23 has a slender thin plate shape that extends in the center axial line C direction. The bands 22 and 23 are disposed at equal intervals in a circumferential direction. For example, the bands 22 and 23 may be made of metal or resin. Steel, stainless steel, copper or the like can be used as the metal. Fiber reinforced plastics (FRP) can be used as the resin. FIG. 1 is the cross-sectional view of the superconductive magnet 1 on which the bands 22 and 23 are not disposed.

An upper end portion 22*a* of the band 22 is fixed to an inner circumferential side of the upper ring member 10*a*. For example, the upper end portion 22*a* of the band 22 is provided with a connector 24 that is a solid block body. A bolt hole 24*a* is formed in the connector 24, a bolt (a bar-shaped tightening member) 25 is inserted into the bolt hole 24*a*, and the bolt 25 extends in the diameter direction D. The connector 24 is tightened to the upper ring member 10*a* using the bolt 25.

As illustrated in FIG. 3, an accommodation portion 41 is formed on an upper end surface 10*g* of the upper ring member 10*a* to accommodate the connector 24. The accommodation portion 41 has a predetermined length in the diameter direction D, and is open toward the inner circumferential side of the upper ring member 10*a*. The connector 24 is disposed on a bottom surface 41*a* of the accommodation portion 41. A female screw portion 41*c* into which the bolt 25 is screwed is provided on a surface 41*b* of the accommodation portion 41, which intersects the diameter direction D.

The band 22 connected to the connector 24 is disposed on the upper end surface 10*g* of the upper ring member 10*a* along the diameter direction D, is bent downward in contact with an inner circumference-side edge portion 41*d* of the accommodation portion 41, and extends in the center axial line C direction on the inner circumferential side of the superconductive coil 8. The inner circumference-side edge portion 41*d* in contact with the band 22 is subjected to a rounding chamfering process. The band 22 is bent along an R portion of the inner circumference-side edge portion 41*d*.

A lower end portion 22*b* of the band 22 is fixed to an inner circumferential side of the cylindrical portion 10*e*. For example, the lower end portion 22*b* of the band 22 is provided with a connector 26 that is a solid block body. A bolt hole 26*a* is formed in the connector 26, and the connector 26 is tightened to the cylindrical portion 10*e* using a bolt 27 that is inserted into the bolt hole 26*a* to extend in the center axial line C direction.

An accommodation portion 42 is formed on an upper surface 10*h* of the cylindrical portion 10*e* to accommodate the connector 26. The accommodation portion 42 is open toward an inner circumferential surface 17 of the cylindrical portion 10*e*. The connector 26 is disposed on a bottom surface 42*a* of the accommodation portion 42. A female screw portion 42*b* into which the bolt 27 is screwed is provided on the bottom surface 42*a* of the accommodation portion 42.

The connector 26 projects to the inside in the diameter direction D farther than the inner circumferential surface 17 of the cylindrical portion 10*e*. Since the connector 26 regulates a position in the diameter direction D of the lower end portion 22*b* of the band 22 connected to the connector 26, a gap $G_{22}$ is formed between an inner circumferential surface 8*b* of the superconductive coil 8 and the band 22.

Since respective structures of the upper and the lower end portions of the band 23 are obtained by reversing the upper and the lower end portions of the band 22, descriptions thereof will be omitted.

A part of the refrigerator 6 is connected to the lower ring member 10*c* (a connected portion is not illustrated), and the superconductive coils 8 and 9 are cooled down to a very low temperature of approximately 4.2 K. For example, it is possible to adopt a small GM refrigerator as the refrigerator 6. The refrigerator 6 as the cooling means may be connected to the upper ring member 10*a*, or may be connected to both of the upper ring member 10*a* and the lower ring member 10*c*. The refrigerator 6 may be connected to at least one of the upper ring member 10*a*, the intermediate bobbin body 10*b* and the lower ring member 10*c*.

The embodiment describes an example in which the cyclotron A is disposed at a posture (a horizontally disposition posture) at which the center axial line C extends in a vertical direction. However, for example, the cyclotron A can be disposed at a posture (a vertically disposition posture) at which the center axial line C extends in a horizontal direction. That is, a dispositional direction of members or the like is not limited by "the top, the bottom, the right and the left" in the description, and the "top and bottom" and the "right and left" can be replaced with each other. For example, the upper pole 4 and the lower pole 5 can be expressed as a left pole or a right pole in a cyclotron that is vertically disposed.

The superconductive coil body 2 is supported by tension-type supporting members 11 and 12. The supporting member 11 is provided between an inner surface of the vacuum chamber 3 and the upper ring member 10*a*. The supporting member 12 is provided between an inner surface of the vacuum chamber 3 and the lower ring member 10*c*. The supporting members 11 and 12 are disposed as a pair of upper and lower members to interpose the superconductive coil body 2 therebetween, and retain a position of the superconductive coil body 2 by pulling the superconductive coil body 2 in opposite directions. The number, dispositions, structures of the supporting members 11 and 12 are not particularly limited, and are appropriately selected based on the size of the cyclotron A and other design factors.

A block body 7*a*, which is apart of the yoke 7, is disposed on a back side (that is, on an outer-surface side in the center axial line C direction) of a surface of the vacuum chamber 3, to which the supporting member 11 or 12 is fixed. The block bodies 7*a* press the vacuum chamber 3 from the outside of the center axial line C to reinforce parts of the vacuum chamber 3, which are fixed to the supporting members 11 and 12.

Figure 4:
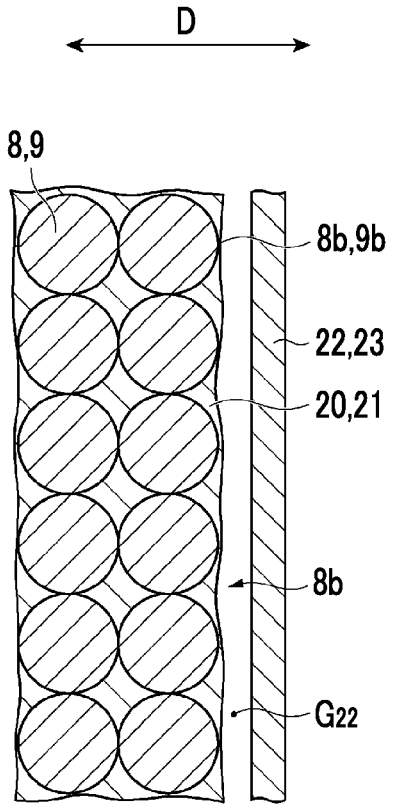
FIG. 4 is a cross-sectional view of a superconductive coil taken along diameter direction D.

As illustrated in FIG. 4, approximately the entire surface of the inner circumference 8*b* of the superconductive coil 8 is coated with an adhesive 20. Approximately the entire surface of an inner circumference 9*b* of the superconductive coil 9 is coated with an adhesive 21. Even though the superconductive coils 8 and 9 expand or shrink, the adhesives 20 and 21 maintain adhesive properties with respect to the superconductive coils 8 and 9. For example, the adhesives 20 and 21 are epoxy resin based adhesives for very low temperatures. The adhesives 20 and 21 are not limited to the epoxy resin based adhesives, and may be other types of adhesives.

In the superconductive magnet 1 with this configuration, the superconductive coil 8 is supported by the upper ring member 10*a* and the cylindrical portion 10*e* on both sides of the center axial line C while being interposed therebetween. The upper ring member 10*a* and the flange portion 10*d* are fixed to the reinforcement ring 31 disposed on the outer circumferential side of the superconductive coil 8 and thus, positions of the upper ring member 10*a* and the flange portion 10*d* are bound.

The band 22 extends along the center axial line C direction on the inner circumferential side of the superconductive coil 8, and connects the upper ring member 10*a* and the cylindrical portion 10*e*. The lower end portion 22*b* of the band 22 is fixed to the cylindrical portion 10*e* using the connector 26, and the upper end portion 22*a* of the band 22 is fixed to the upper ring member 10*a* using the connector 24.

The connector 24 is attached to the upper ring member 10*a* using the bolt 25 that extends in the diameter direction D. When the bolt 25 is tightened, the connector 24 slides on the bottom surface 41*a* of the accommodation portion 41 to move toward the outside in the diameter direction D. Accordingly, tension can be imparted on the band 22 in the center axial line C direction. Since the upper ring member 10*a* and the cylindrical portion 10*e* are drawn toward each other due to exertion of the tension on the band 22, the superconductive coil 8 can be tightened and bound by the upper ring member 10*a* and the cylindrical portion 10*e*.

Furthermore, it is possible to increase the tension imparted on the band 22 by tightening the bolt 25. Accordingly, it is possible to adjust the tension imparted on the band 22 and to rigidly bind the superconductive coil 8.

In contrast, when the bolt 25 is untightened, the connector 24 slides on the bottom surface 41*a* of the accommodation portion 41 to move toward the inside in the diameter direction D. Accordingly, it is possible to decrease the tension imparted on the band 22. In this manner, it is possible to adjust the tension imparted on the band 22, and to relax the binding of the superconductive coil 8. Similar to the superconductive coil 8, the superconductive coil 9 is also bound by the band 23.

The superconductive coils 8 and 9 are cooled by the refrigerator 6 and thus, a state of the superconductive magnet 1 becomes a very low temperature state. At this time, the bands 22 and 23 are cooled to shrink, and tension of the bands 22 and 23 increases.

When a current flows through the superconductive coils 8 and 9 that are cooled down to a very low temperature and put in a superconductive state, the superconductive magnet 1 generates a powerful magnetic field. The cyclotron A accelerates an electrically charged particle to output an electrically charged particle beam by generating the high magnetic field using the superconductive magnet 1.

In the superconductive magnet 1, since the superconductive coils 8 and 9 are air-core coils, the superconductive coils 8 and 9 and the inner bobbin do not rub against each other, and frictional heat does not occur. Accordingly, occurrence of the quench can be reduced. Since the bands 22 and 23 are formed in a belt shape, the bands 22 and 23 can be respectively disposed in narrow spaces on the inner circumferential sides of the superconductive coils 8 and 9. Accordingly, it is possible to suppress enlargement of the superconductive magnet 1 and occurrence of the quench by binding the superconductive coils 8 and 9 on the respective inner circumferential sides thereof and by preventing the wire movements of the superconductive coils 8 and 9. As a result, it is possible to improve reliability of the superconductive magnet 1.

In the superconductive magnet 1, since it is possible to adjust the tension imparted on the bands 22 and 23, it is possible to suppress occurrence of the quench by reliably binding the superconductive coils 8 and 9 and thus prevent the wire movement.

Furthermore, in the superconductive magnet 1, the inner circumference-side edge portion 41*d* of the accommodation portion 41 is subjected to a round chamfering process. Accordingly, it is possible to bend the bands 22 and 23 along the edge portion 41*d*. It is possible to reduce a possibility of frictional heat generating due to rubbing between the bands 22 and 23 and the edge portion 41*d* and to suppress occurrence of the quench.

In the superconductive magnet 1, since the gap is provided between the superconductive coil 8 and the band 22 in the diameter direction D of the superconductive coil 8, the superconductive coil 8 and the band 22 are configured not to come into contact with each other, there is no possibility of generation of frictional heat, and occurrence of the quench can be prevented.

Another Embodiment

A superconductive magnet 51 of another embodiment is different from the superconductive magnet 1 of the embodiment in that the superconductive magnet 51 includes a wire-shaped inner circumference-side tension imparted portion instead of the band 22, and in that a tension adjustment portion capable of adjusting tension imparted on the inner circumference-side imparted portion has a configuration different from that of the embodiment.

Figure 5:
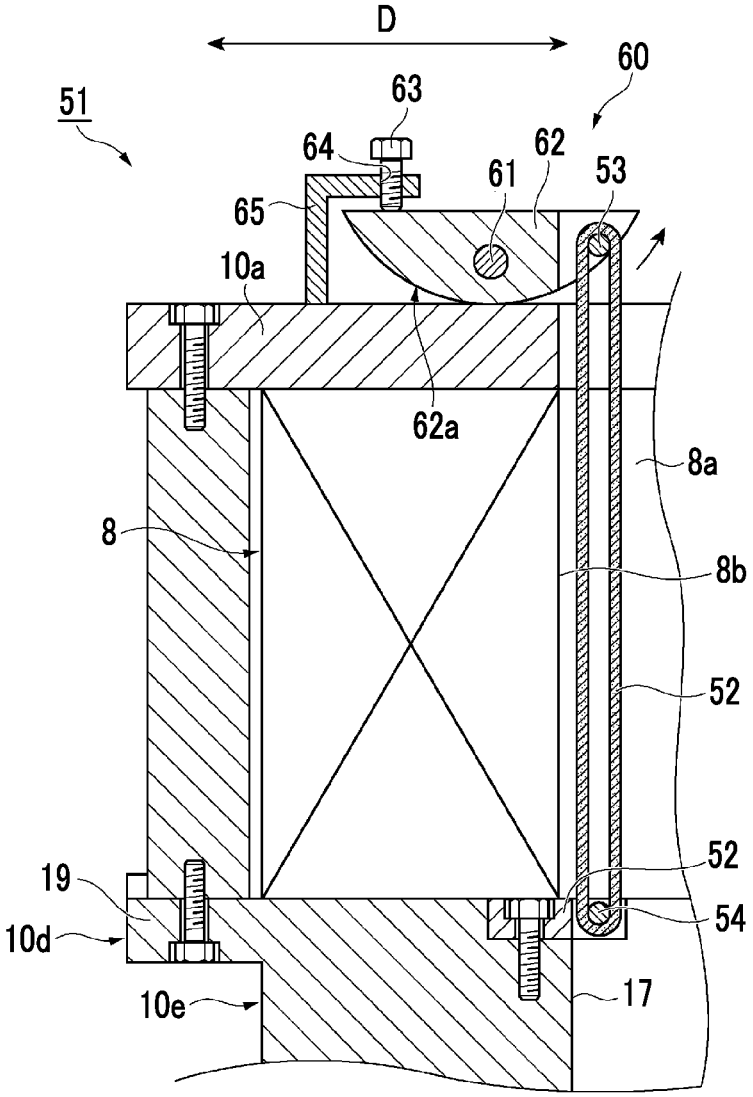
FIG. 5 is a schematic cross-sectional view illustrating a superconductive magnet of another embodiment according to the present invention.

As illustrated in FIG. 5, the superconductive magnet 51 includes an endless wire-shaped member 52 on the inner circumferential side of the superconductive coil 8, and the wire-shaped member 52 connects the upper ring member 10*a* and the cylindrical portion 10*e*. The wire-shaped member 52 extends in the center axial line C direction. The wire-shaped member 52 is hung between pins 53 and 54 which are disposed apart from each other in the vertical direction.

The lower pin 54 is supported by a connector 55 fixed to the cylindrical portion 10*e*. For example, the pin 54 is disposed in a direction orthogonal to the diameter direction D. The connector 55 projects toward the center axial line C farther than the inner circumferential surface 17 of the cylindrical portion 10*e*, and the pin 54 regulates a position of a lower end side of the wire-shaped member 52 on a center axial line C side farther than the superconductive coil 8.

The upper pin 53 is supported by a tension adjustment portion 60 provided on the upper ring member 10*a*. The tension adjustment portion 60 rotationally moves about a rotational shaft 61 fixed to the upper ring member 10*a*, and includes a position adjustment member 62 that can adjust a position of the pin 53. The rotational shaft 61 is disposed to be apart upward from the upper ring member 10*a*. The position adjustment member 62 has a curved surface that faces the upper ring member 10*a*. A radius of curvature of a curved surface 62*a* is defined to gradually change along a circumferential position of the curved surface 62*a*. That is, when the position adjustment member 62 rotationally moves, the curved surface 62*a* of the position adjustment member 62 comes into contact with the upper ring member 10*a* at a changed position. Accordingly, it is possible to adjust a pressing force of the position adjustment member 62 with respect to the upper ring member 10*a*.

The position adjustment member 62 is pressed from the top by a bolt 63 that extends in the vertical direction. The bolt 63 is supported by a supporting member 65 that is provided with a female screw portion 64. The supporting member 65 is fixed to the upper ring member 10*a*, and the bolt 63 is screwed into the female screw portion 64. When the bolt 63 is screwed into the female screw portion 64, the bolt 63 moves downward to change a rotational position of the position adjustment member 62. When the bolt 63 is screwed into the female screw portion 64, the position adjustment member 62 rotationally moves about the rotational shaft 61 as a fulcrum, and the pin 53 moves upward. As a result, it is possible to increase tension imparted on the wire-shaped member 52. Accordingly, the upper ring member 10*a* and the cylindrical portion 10*e* are drawn toward each other in the center axial line C direction, and the superconductive coil 8 can be tightened from both sides.

Since the superconductive magnet 51 includes the wire-shaped member 52, on which tension is imparted in the center axial line C direction, on the inner circumferential side of the superconductive coil 8, the wire movement of the superconductive coil 8 is suppressed, and occurrence of the quench can be reduced. The superconductive magnet 51 may be configured to include an endless belt type inner circumference-side tension imparted portion instead of the endless wire-shaped member 52. The pins 53 and 54 may be connected to the belt-shaped or the wire-shaped inner circumference-side tension imparted portion which has the connectors provided on end portions in longitudinal directions.

The present invention is not limited to the embodiments described above, and the following various modifications can be made to the present invention insofar as the modifications do not depart from the scope of the present invention.

The embodiments are configured to include the cylindrical reinforcement ring 31 as the outer circumference-side binding portion that binds the pair of bobbin bodies which extend in the center axial line C direction on the outer circumferential side of the superconductive coil. However, the outer circumference-side binding portions may be bar-shaped members that are disposed at predetermined intervals in the circumferential direction.

In the superconductive magnets 1 and 51, the superconductive coils 8 and 9 are covered with insulation materials and thus, cooling efficiency may improve.

The present invention is not limited to the embodiments in which the superconductive coil body 2 of the superconductive magnet 1 has two superconductive coils 8 and 9. However, the present invention may have one superconductive coil or three or more superconductive coils.

The superconductive magnet according to the embodiments of the present invention is not limited to the cyclotron, and is applicable to an apparatus that pulls up a silicon single crystal using the MCZ method. The superconductive magnet is applicable to any apparatus insofar as the apparatus can generate a high magnetic field.

It should be understood that the invention is not limited to the above-described embodiment, but may be modified into various forms on the basis of the spirit of the invention. Additionally, the modifications are included in the scope of the invention.

What is claimed is:

1. A superconductive magnet comprising:

a superconductive coil that is an air-core coil;

a pair of bobbin bodies that support the superconductive coil while interposing the superconductive coil therebetween on both sides of a center axial line direction of the superconductive coil;

an outer circumference-side binding portion that extends in the center axial line direction on an outer circumferential side of the superconductive coil to bind the pair of bobbin bodies; and a belt-shaped or a wire-shaped inner circumference-side tension imparted portion which extends in the center axial line direction on an inner circumferential side of the superconductive coil to connect the pair of bobbin bodies, and on which tension is imparted in the center axial line direction.

2. The superconductive magnet according to claim 1, further comprising:

a tension adjustment portion that can adjust the tension imparted on the inner circumference-side tension imparted portion.

3. The superconductive magnet according to claim 2, wherein the tension adjustment portion has a bar-shaped tightening member that tightens end portions in a longitudinal direction of the inner circumference-side tension imparted portion to the bobbin bodies, and adjusts the tension imparted on the inner circumference-side tension imparted portion by adjusting the tightening of the tightening member.

4. The superconductive magnet according to claim 3, wherein the tightening member extends in a diameter direction of the superconductive coil on an outer surface in the center axial line direction of the bobbin body, wherein the end portion in the longitudinal direction of the inner circumference-side tension imparted portion is disposed on the outer surface in the center axial line direction of the bobbin body, wherein the inner circumference-side tension imparted portion is in contact with an end portion on the inner circumferential side of the bobbin body, and is bent toward the inner circumferential side of the superconductive coil from an outer-surface side in the center axial line direction of the bobbin body, and wherein the end portion on the inner circumferential side of the bobbin body, the end portion being in contact with the inner circumference-side tension imparted portion, is subjected to a round chamfering process.

5. The superconductive magnet according to claim 1, wherein a gap is provided between the superconductive coil and the inner circumference-side tension imparted portion in the diameter direction of the superconductive coil.

6. The superconductive magnet according to claim 1, wherein the end portion of the bobbin body on the inner circumferential side of the superconductive coil projects to the inside farther than an inner circumferential surface of the superconductive coil.

* * * * *